US006209500B1

(12) United States Patent
Tallio et al.

(10) Patent No.: US 6,209,500 B1
(45) Date of Patent: Apr. 3, 2001

(54) COLD START FUEL PREHEAT SYSTEM FOR INTERNAL COMBUSTION ENGINE

(75) Inventors: Kevin Verne Tallio, Saline; Eric Warren Curtis, Milan; Michael Bruno Magnan, Dearborn, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/488,196

(22) Filed: Jan. 19, 2000

(51) Int. Cl.[7] ..... F02N 17/00
(52) U.S. Cl. ..... 123/179.21; 123/553; 123/557
(58) Field of Search ..... 123/557, 553, 123/179.21

(56) References Cited

U.S. PATENT DOCUMENTS

| | | | | |
|---|---|---|---|---|
| 4,414,932 | | 11/1983 | Lindberg . | |
| 4,461,249 | | 7/1984 | Majkrzak . | |
| 4,612,896 | * | 9/1986 | Leibrand | 123/557 |
| 4,972,901 | | 11/1990 | Hormansdorfer . | |
| 4,991,644 | | 2/1991 | Miaoulis et al. . | |
| 5,540,198 | | 7/1996 | Hurner . | |
| 5,611,392 | | 3/1997 | Malecek et al. . | |
| 5,662,090 | | 9/1997 | Ward . | |

* cited by examiner

*Primary Examiner*—Marguerite McMahon
(74) *Attorney, Agent, or Firm*—Jerome R. Drouillard

(57) ABSTRACT

A cold start fuel preheat system for an internal combustion engine includes a housing and a fuel rail extending through the housing to deliver fuel to the internal combustion engine. The cold start fuel preheat system also includes a phase transform material disposed in the housing and about the fuel rail. The cold start fuel preheat system further includes a mechanism for heating the phase transform material such that the phase transform material stores the heat and transfers the stored heat to the fuel during cold start of the internal combustion engine.

20 Claims, 2 Drawing Sheets

COLD START FUEL PREHEAT SYSTEM FOR INTERNAL COMBUSTION ENGINE

BACKGROUND OF THE INVENTION

1. Field Of the Invention

The present invention relates generally to internal combustion engines and, more specifically, to a cold start fuel preheat system for improved atomization of fuel in an internal combustion engine.

2. Description of the Related Art

It is known to provide a fuel-air mixture for an internal combustion engine, which needs good preparation of liquid fuel such as gasoline and air to burn efficiently. This is accomplished by a fuel injection system comprising a carburetor or fuel injector. The ideal fuel-air mixture delivered to the intake manifold should be a homogeneous mixture of minute fuel particles in air to facilitate subsequent vaporization of the liquid fuel. The mixture should have composition or strength to develop maximum economy for each condition of engine operation. When an engine is burning such an ideal fuel-air mixture, maximum combustion of the fuel is achieved while smoke and unburned fuel in the exhaust are held to a minimum.

Cold fuel temperatures are known to result in severe degradation of atomization quality and fuel vaporization rate. These effects result in the need to utilize enrichment strategies to guarantee stable operation of the cold engine. Enrichment strategies require that fuel in excess of that required for normal engine operation be injected to ensure that enough fuel vapor is available in the combustion chamber.

The need for improving the fuel-air mixture in the combustion chamber has been recognized for many years. One attempted solution to this need has been to install electrically heated fuel injectors in the internal combustion engine to preheat and improve atomization of the fuel. However, there is still a need in the art, during cold start, to improve fuel atomization and vaporization, reduce hydrocarbon (HC) emissions, and reduce fuel consumption.

SUMMARY OF THE INVENTION

Accordingly, the present invention is cold start fuel preheat system for an internal combustion engine including a housing and a fuel rail extending through the housing to deliver fuel to the internal combustion engine. The cold start fuel preheat system also includes a phase transform material disposed in the housing and about the fuel rail. The cold start fuel preheat system further includes a mechanism for heating the phase transform material such that the phase transform material stores the heat and transfers the stored heat to the fuel during cold start of the internal combustion engine.

One feature of the present invention is that a cold start fuel preheat system is provided for improved atomization of fuel in an internal combustion engine. Another feature of the present invention is that the cold start fuel preheat system improves vaporization of incoming fuel spray and enhances mixing of the charge. Yet another feature of the present invention is that the cold start fuel preheat system reduces, during "cold start", enrichment requirements by preheating the fuel to a temperature that ensures good atomization quality and promotes fuel vaporization. A further feature of the present invention is that the cold start fuel preheat system heats fuel sufficiently to overcome cold start fuel atomization issues without excessive heating and an energy storage solution is utilized to recover energy from the engine coolant to heat the fuel during subsequent cold start operations.

Other features and advantages of the present invention will be readily appreciated, as the same becomes better understood, after reading the subsequent description when considered in connection with the accompanying drawings.

DESCRIPTION OF THE PREFERRED EMBODIMENT(S)

Figure 1:
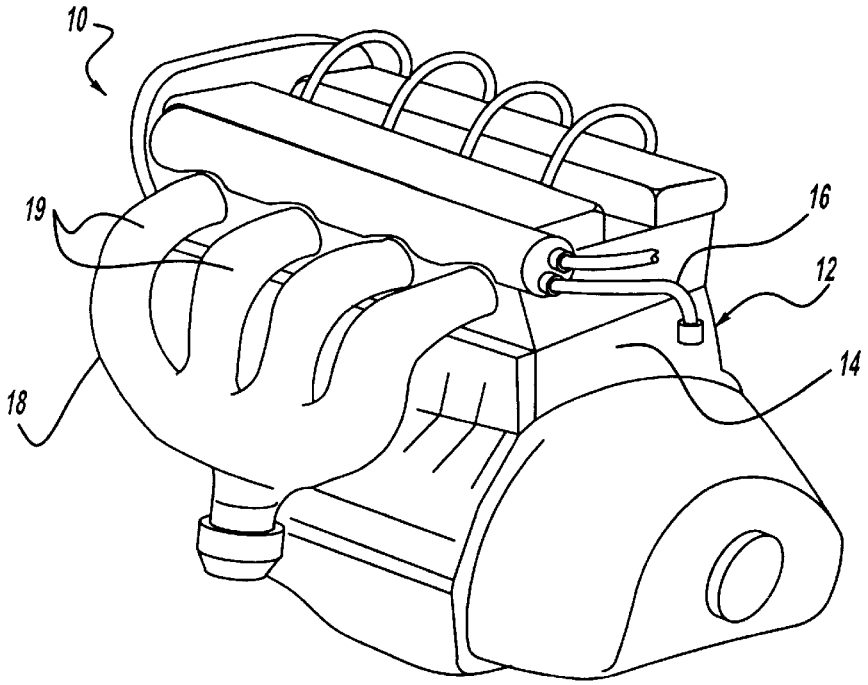
FIG. 1 is a perspective view of a cold start fuel preheat system, according to the present invention, illustrated in operational relationship with an internal combustion engine.

Referring to the drawings and in particular FIG. 1, one embodiment of an apparatus or cold start fuel preheat system 10, according to the present invention, is illustrated in operational relationship with an internal combustion engine, generally indicated at 12. The internal combustion engine 12 includes an engine block 14 having a plurality of combustion chambers (not shown) for combusting a fuel and air mixture. The internal combustion engine 12 includes a fuel rail 16 extending longitudinally and fluidly communicating with fuel injectors (not shown) for the combustion chambers. The fuel rail 16 may include a plurality of fins 17 attached to an exterior surface thereof to conduct heat transfer during cold start in a manner to be described. The internal combustion engine 12 also includes an exhaust manifold 18 operatively connected to the engine block 14 for receiving exhaust gases therefrom. The exhaust manifold 16 has a plurality of pipes 19 operatively connected to the individual combustion chambers. The cold start fuel preheat system 10 is disposed about the fuel rail 16 and mounted to the internal combustion engine 12 over the pipes 19 of the exhaust manifold 18. The cold start fuel preheat system 10 heats the fuel during cold start of the internal combustion engine 12 in a manner to be described in which a fuel injector (not shown) sprays fuel into a primary flow or inlet runner (not shown). This fuel mixes with the air flowing through the primary inlet runner and the fuel-air mixture then passes through an inlet valve (not shown) and into a combustion chamber where the mixture is ignited by a spark igniter (not shown).

Figure 2:
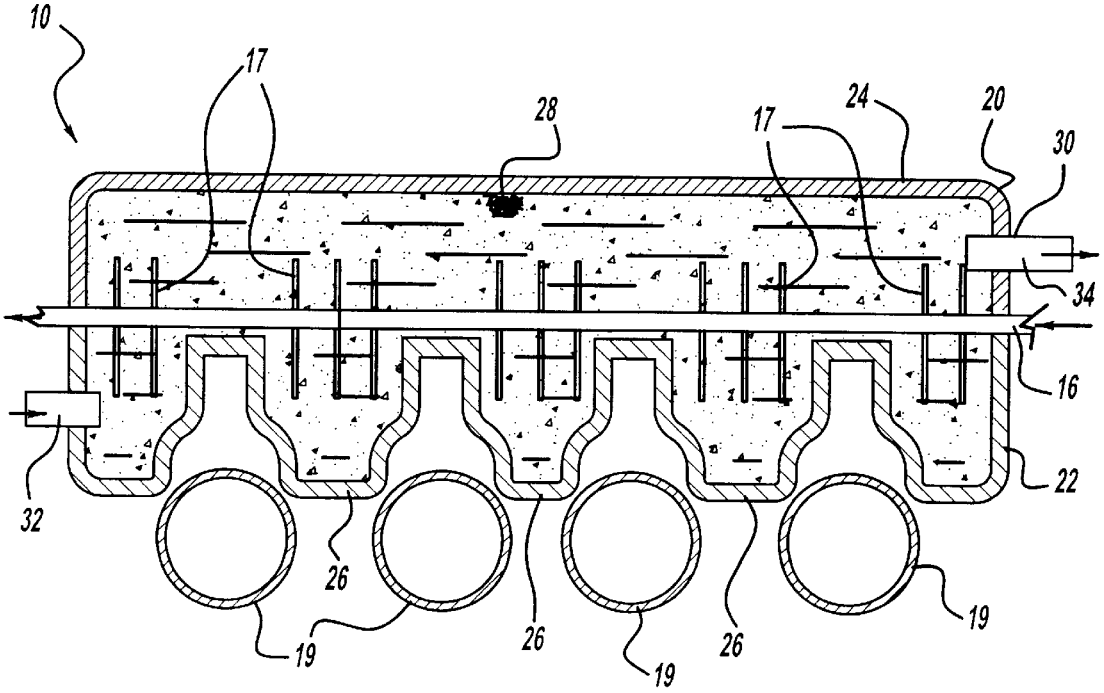
FIG. 2 is a fragmentary elevational view of the cold start fuel preheat system of FIG. 1.

As illustrated in FIGS. 1 and 2, the cold start fuel preheat system 10 includes an insulated or thermal housing 20 placed across the pipes 19 of the exhaust manifold 18. The housing 20 is generally rectangular in shape, but may have any suitable shape. The housing 20 may include a first or lower half shell 22 and a second or upper half shell 24. The lower half shell 22 includes at least one, preferably a plurality of pockets 26 therein. The pockets 26 are spaced longitudinally to accommodate the pipes 18 therebetween. The upper half shell 24 is secured to the lower half shell 22 by suitable means such as welding. It should be appreciated that the fuel rail 16 extends longitudinally through the housing 20 and that the fins 17 are disposed in the pockets 26 of the housing 20. It should also be appreciated that the housing 20 is placed on or near the engine 12 and, as illustrated in FIG. 2, receives heat from the exhaust manifold 18.

The cold start fuel preheat system 10 also includes a phase transform material disposed in the housing 20 between the lower half shell 22 and the upper half shell 24. The phase transform material 28 is in the form of phase change energy storage pellets. The pellets are made of a suitable material such as a salt encapsulated in a polymer bead. The salt inside the polymer bead stores energy by converting from a solid phase to a liquid phase and heat can be removed by converting from the liquid phase to the solid phase. The phase transform material 28 stores thermal energy for use during cold start operation in a manner to be described. The phase transform material is commercially available as encapsulated PCM TH89 from PCM Thermal Solutions, Naperville, Ill. It should be appreciated that the phase transform material 28 can deliver significant amounts of heat at nearly constant temperature. It should also be appreciated that the volume of phase transform material 28 inside the housing 20 is based on size and warm-up requirements of the engine 12.

The cold start fuel preheat system 10 further includes an engine coolant line 30 having an inlet 32 extending into one end of the housing 20 and an outlet 34 extending into the other end of the housing 20. The engine coolant line 30 is discontinuous between the inlet 32 and outlet 34 to allow engine coolant to circulate through the phase transform material 28 in the housing 20. The inlet 32 is fluidly connected to a heater core (not shown) and the outlet 34 is fluidly connected to a radiator (not shown). It should be appreciated that the upper half shell 24 and lower half shell 22 are sealed together by suitable means to prevent leakage of the engine coolant from the housing 20. It should also be appreciated that the housing 20 is of a sufficient size to accommodate the fuel rail 16, phase transform material 28 and engine coolant line 30. It should further be appreciated that the engine coolant line 30 may be continuous and include a plurality of coils between the inlet 32 and outlet 34 similar to that described in connection with FIG. 3.

In operation of the cold start fuel preheat system 10, under warmed-up operating conditions, the engine coolant such as water enters through the inlet 32 of the engine coolant line 30 and circulates through the housing 20. The engine coolant provides the thermal energy necessary to heat the phase transform material 28 that stores thermal energy for use during later cold start operation. As the coolant circulates, it will transfer energy to the phase transform material 28. Control valves (not shown) can be used to control the flow of coolant through the housing 20 both during cold start operation and normal operating temperatures to prevent unnecessary removal of heat from the phase transform material 28 by the cold engine coolant and during hot operation to prevent overheating of the phase transform material 28.

During cold start operation of the engine 12, fuel from the fuel tank (not shown) may be allowed to enter the cold start fuel preheat system 10 via a fuel pump (not shown) and be heated to the appropriate temperature by the phase transform material 28 as it flows through the fuel rail 16. Heat is removed from the phase transform material 28 by heat transfer through the fins 17 and fuel rail 16 to the cold fuel flowing through the fuel rail 16. The cold start fuel preheat system 10 delivers the warmed fuel to the fuel injectors at a sufficiently high temperature to ensure good atomization quality, thereby minimizing transient air-fuel ratio excursions during cold engine operation. It should be appreciated that improved air-fuel ratio control during cold start will reduce hydrocarbon emission and reduce or eliminate the need for cold start enrichment. It should also be appreciated that heat removed from the cold start fuel preheat system 10 during cold engine operation is replaced by circulation of engine coolant through the system 10 after the engine 12 reaches its normal operating condition.

Figure 3:
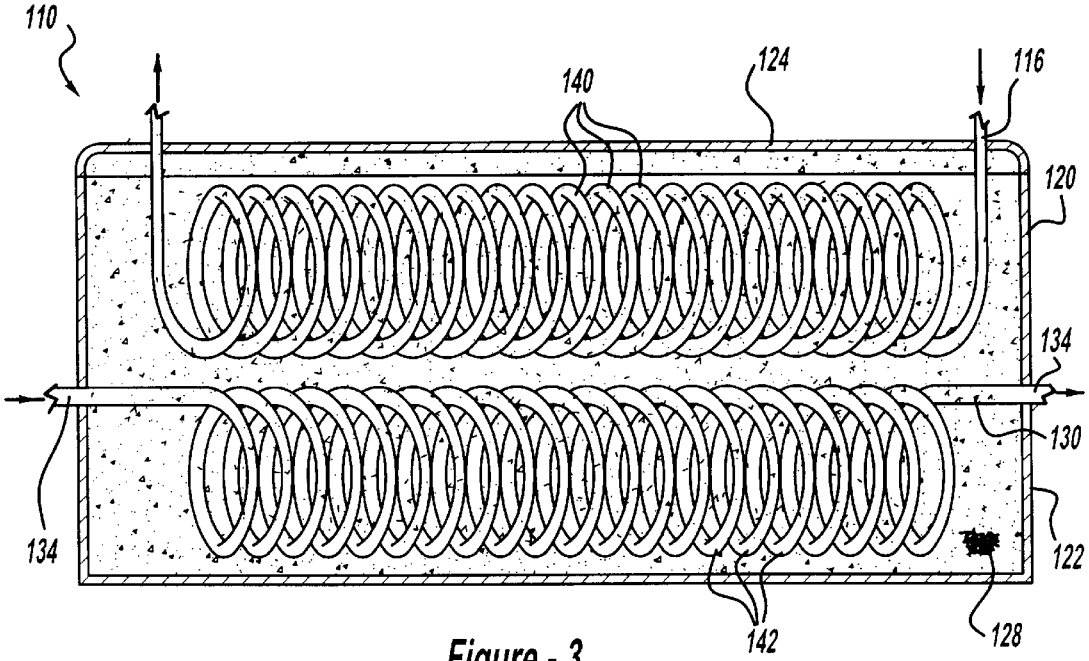
FIG. 3 is an exploded perspective view of another embodiment, according to the present invention, of the cold start fuel preheat system of FIG. 1.

Referring to FIG. 3, another embodiment 110, according to the present invention, of the cold start fuel preheat system 10 is illustrated. Like parts of the cold start fuel preheat system 10 have like reference numerals increased by one hundred (100). In this embodiment, the cold start fuel preheat system 110 includes the housing 120 remotely located from the engine 12. The cold start fuel preheat system 110 also includes the fuel rail 116 extending into the upper half shell 124 and having a plurality of coils 140 spaced longitudinally and exiting through the upper half shell 124. The cold start fuel preheat system 110 includes the engine coolant line 130 extending into the lower half shell 122 and having a plurality of coils 142 between the inlet 132 and the outlet 134. The operation of the cold start fuel preheat system 110 is similar to the cold start fuel preheat system 10. It should be appreciated that the fuel line 116 has a sufficient number of coils 140 to ensure that adequate warm fuel is available during cold start and engine warm-up. It should also be appreciated that the housing 120 is of a sufficient size to accommodate the coils 140 of the fuel rail 116, the coils 142 of the engine coolant line 130 and enough phase transform material 128 to ensure that adequate thermal energy is available to keep the fuel temperature at the correct level for cold engine operation. It should further be appreciated that the coils 142 of the engine coolant line 130 provide thermal energy from the engine during fully warmed-up operation. It should still further be appreciated that the housing 120 may be located as near the engine 12 as possible to minimize the volume of cold fuel delivered to the engine 12 during cold start operation.

Alternatively, the cold start fuel preheat system 110 may use exhaust gas from the engine 12 to supply the thermal energy to the system 110 instead of using engine coolant or replacing the coils 140 of the fuel rail 116 with a spherical or cylindrical vessel to contain the fuel. Also, a thermostatically controlled valve may be incorporated to bleed cold fuel from the fuel rail 116 and replace it with warm fuel from the housing to ensure that the fuel is available at the fuel injectors during cold start.

Accordingly, the cold start fuel preheat system 10,110 allows preheated fuel to be available to a cold engine at key-on (i.e., no time delay for heating the fuel or the system). The cold start fuel preheat system 10,110 does not require an additional energy source for operation. The cold start fuel preheat system 10,110 is a passive heat transfer mechanism and the only mechanical components are associated with coolant flow through the system, reducing complexity.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A cold start fuel preheat system for an internal combustion engine comprising:

a housing;

a fuel rail extending through said housing to deliver fuel to the internal combustion engine;

a phase transform material disposed in said housing and about said fuel rail; and means for heating said phase transform material such that said phase transform material stores the heat and transfers the stored heat to the fuel during cold start of the internal combustion engine.

2. A cold start fuel preheat system as set forth in claim 1 wherein said heating means comprises an engine coolant line extending through said housing to allow flow of engine coolant therethrough.

3. A cold start fuel preheat system as set forth in claim 2 wherein said engine coolant line has a plurality of coils disposed in said housing.

4. A cold start fuel preheat system as set forth in claim 2 wherein said engine coolant line is discontinuous in said housing.

5. A cold start fuel preheat system as set forth in claim 1 wherein said phase transform material comprises a plurality of pellets.

6. A cold start fuel preheat system as set forth in claim 1 wherein said fuel rail comprises a fuel line extending through said housing to allow flow of fuel therethrough.

7. A cold start fuel preheat system as set forth in claim 6 wherein said fuel line has a plurality of coils disposed in said housing.

8. A cold start fuel preheat system as set forth in claim 6 wherein said fuel line is continuous in said housing.

9. A cold start fuel preheat system as set forth in claim 1 wherein said heating means comprises an exhaust gas line extending through said housing to heat said phase transform material.

10. A cold start fuel preheat system as set forth in claim 1 wherein said fuel rail includes a vessel to contain fuel.

11. A cold start fuel preheat system for an internal combustion engine comprising:

a housing;

a fuel rail extending through said housing to deliver fuel to the internal combustion engine;

a phase transform material disposed in said housing and about said fuel rail; and an engine coolant line extending into said housing to allow flow of engine coolant therethough for heating said phase transform material such that said phase transform material stores the heat and transfers the stored heat to the fuel during cold start of the internal combustion engine.

12. A cold start fuel preheat system as set forth in claim 11 wherein said engine coolant line has a plurality of coils disposed in said housing.

13. A cold start fuel preheat system as set forth in claim 11 wherein said engine coolant line is discontinuous in said housing.

14. A cold start fuel preheat system as set forth in claim 11 wherein said phase transform material comprises a plurality of pellets.

15. A cold start fuel preheat system as set forth in claim 11 wherein said fuel rail comprises a fuel line extending through said housing to allow flow of fuel therethrough.

16. A cold start fuel preheat system as set forth in claim 15 wherein said fuel line has a plurality of coils disposed in said housing.

17. A cold start fuel preheat system as set forth in claim 15 wherein said fuel line is continuous in said housing.

18. A cold start fuel preheat system as set forth in claim 11 wherein said phase transform material is made of a salt encapsulated in a polymer.

19. A cold start fuel preheat system as set forth in claim 11 wherein said fuel rail includes a vessel to contain fuel.

20. A cold start fuel preheat system for an internal combustion engine comprising:

a housing;

a fuel rail having a plurality of coils disposed in said housing to deliver fuel to the internal combustion engine;

a phase transform material disposed in said housing and about said fuel rail; and an engine coolant line having a plurality of coils disposed in said housing to allow flow of engine coolant therethough for heating said phase transform material such that said phase transform material stores the heat and transfers the stored heat to the fuel during cold start of the internal combustion engine.

* * * * *